US006918513B1

(12) United States Patent
Downey

(10) Patent No.: US 6,918,513 B1
(45) Date of Patent: Jul. 19, 2005

(54) TOILET TISSUE DISPENSER WITH LIQUID SPRAY

(76) Inventor: Kevin Downey, 6111 87th Ave., New Carrollton, MD (US) 20784

( * ) Notice: Subject to any disclaimer, the term of this patent is extended or adjusted under 35 U.S.C. 154(b) by 0 days.

(21) Appl. No.: 10/816,647

(22) Filed: Apr. 5, 2004

(51) Int. Cl.[7] ..... B67D 1/07
(52) U.S. Cl. ..... 222/192; 222/321.7
(58) Field of Search ..... 222/192, 321.7

(56) References Cited

U.S. PATENT DOCUMENTS 4,901,889 A * 2/1990 Mitchell ..... 222/192

* cited by examiner

*Primary Examiner*—Philippe Derakshani
(74) *Attorney, Agent, or Firm*—Richard L. Huff

(57) ABSTRACT

A device for selectively wetting pieces of toilet paper. The device contains a hollow two-piece mandrel containing a nub at each end. The nub of the first piece contains a stabilizing pin for keeping the device in the upright position. The first piece also contains a spring for maintaining outward pressure on the two pieces. The second piece contains an enclosure for a desired liquid lying along a tilted platform and a manually controlled actuator and dip tube. Pushing down the actuator results in a spray of the desired fluid directed at several pieces of toilet paper which have been removed from the roll.

3 Claims, 4 Drawing Sheets

TOILET TISSUE DISPENSER WITH LIQUID SPRAY

CROSS-REFERENCE TO RELATED APPLICATIONS

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates to a hygienic device comprising an enclosure within the mandrel of a toilet paper dispenser, which enclosure is attached to an actuator. The device dispenses disinfectant, deodorant, lotions, etc. in liquid spray form upon being activated by the user.

2) Description of the Related Art

It is known in the prior art that the ideal method of cleaning the anal area following a bowel movement is the use of dry toilet paper to remove the adhering fecal material followed by the use of toilet paper moistened with water, a disinfectant, a deodorizer, a moisturizer, an anesthetic, etc. to treat the area in whatever way is necessary.

One method of moistening the toilet paper is to dampen the pulled-off sections with water or other liquid by pouring the liquid onto the paper or dipping the paper into water. This is wasteful of the liquid and gets more of the liquid on the paper than is wanted, needed or useful as the paper becomes a wet ball.

Devices for spraying the desired liquid onto the paper are known in the art.

British Patent No. 877,478 issued to Tondelli Jan. 17, 1962 discloses a container located above the roll of toilet paper which may be manually activated to spray the desired liquid on the toilet paper which has been pulled away from the roll.

U.S. Pat. No. 2,789,725 issued to Carper Apr. 23, 1957 discloses a dispensing device containing sheets of cleaning paper, which sheets may be wetted by a desired liquid contained in a bulbous container within the device upon manually compressing the container. Due to the configuration of the device, the liquid will be in flowable form when it is applied to the cleaning paper.

U.S. Pat. No. 3,796,185 issued to Boone Mar. 12, 1974 discloses a device located below a roll of toilet paper capable of being manually operated to spray a desired liquid on the roll of toilet paper.

U.S. Pat. No. 3,910,229 issued to Spencer Oct. 7, 1975 teaches a reservoir of desired liquid inside a hermetically sealed mandrel for a toilet paper roll. The liquid automatically wets the toilet paper as it is unwound.

U.S. Pat. No. 4,667,846 issued to Marceau May 26, 1987 discloses a number of sheets of toilet paper within a box held within a tank, which tank contains a desired liquid. The device may be manually activated to spray the desired liquid on the uppermost sheet.

U.S. Pat. No. 5,435,465 issued to El-Amin Jul. 25, 1995 discloses a wall-mounted apparatus holding a container for liquid which may be used to moisten toilet paper following removal from the roll and before use.

U.S. Pat. No. 5,672,206 issued to Gorman Sep. 30, 1997 discloses a hollow mandrel for supporting a roll of toilet paper. The mandrel contains a desired liquid which is automatically dispensed onto the first sheet on a roll just before the first sheet is removed from the roll.

U.S. Pat. No. 5,887,759 issued to Ayigbe Mar. 30, 1999 discloses a container above the roll of toilet paper capable of being manually activated to spray a desired liquid on toilet paper which has been pulled away from the roll.

U.S. Pat. No. 6,314,971 issued to Schneider Nov. 13, 2001 discloses a motor-driven liquid dispenser located below the roll of toilet paper capable of being turned on or off manually and capable of spraying a desired liquid on toilet paper which has been pulled away from the roll.

U.S. Pat. No. 6,346,153 issued to Lake et al Feb. 12, 2002 discloses a dispenser device having a box having a roll of toilet paper. The box also contains a liquid and the device may be manually adjusted to dispense dry or wet tissues.

U.S. Pat. No. 6,457,434 issued to Lazar Oct. 1, 2002 discloses a device which permits the user to choose from a variety of liquids to be sprayed on a toilet tissue prior to dispensing.

U.S. Pat. No. 6,457,893 issued to Hamilton Oct. 1, 2002 discloses a wall-mounted bracket for holding a bottle of desired liquid which may dispense the liquid onto a piece of toilet paper.

U.S. Pat. No. 6,467,654 issued to Ayres Oct. 22, 2002 discloses a dispenser for a roll of toilet paper which has a bottle of desired liquid attached to it by a cord.

Each of the above devices exhibits at least one of the following disadvantages.

Areas containing toilets, especially public restroom areas, are limited in room. Any extra devices or any increase in size of the toilet paper dispenser takes up additional room and leads to a feeling of claustrophobia. Any of the described devices for dispensing the combination of toilet paper plus the desired liquid or just the desired liquid occupies more room than just a conventional toilet paper dispenser and adds to the problem of reducing the available space in a bathroom or stall.

As noted above, the ideal wiping method makes use of dry paper first, followed by paper treated with a desired liquid. The above-described devices which automatically wet each sheet or the first sheet do not allow for the ideal method to take place. Also, those devices which automatically wet each sheet do not allow the user to avoid contact with a liquid to which he or she may be sensitive. Such a liquid may be any liquid having a preservative.

BRIEF SUMMARY OF THE INVENTION

The present invention retains the beneficial characteristics of the prior art devices while avoiding the disadvantageous characteristics. Thus, the device of the present invention adds no additional volume to the conventional toilet paper dispenser and it allows the user to have complete control over the tissues which will remain dry and those which will be dampened.

The device of the present invention comprises a hollow two-piece mandrel for a toilet paper roll. The mandrel is so sized as to fit into a conventional holder for conventional mandrels for toilet paper rolls. The mandrel has a nub at each end for fitting into the holes in the conventional holders. A roll stabilizing pin passes through the nub on the outer end of the first piece of the mandrel. This pin keeps the mandrel from turning. The first piece of the mandrel also contains a spring which keeps the mandrel engaged with the holders.

The second piece of the mandrel contains an enclosure for the desired liquid. The enclosure contains a cap to enable the enclosure to be refilled. The enclosure rests upon a platform which is tilted downwardly and distally so as to ensure that the liquid is available at the distal end of the mandrel. There is a spray pump on the upper surface of the distal end of the second piece of the mandrel. The spray pump has an intake port which is located near the lowest point of the enclosure. The spray pump may be manually operated.

In operation, the user removes as much dry toilet tissue as is necessary. This dry toilet tissue remains dry as is desirable for the first portion of the cleaning process. The user then removes a supply of toilet tissue, activates the spray pump and wets this tissue. In this way only the desired pieces of tissue are wet by the desired solution, thus saving on the quantity of the liquid used and allowing for ideal cleaning. The device of this invention takes up essentially no more room than a conventional toilet paper holder and thus eliminates the undesirable characteristics of many of the prior art devices.

DETAILED DESCRIPTION OF THE INVENTION

Figure 1:
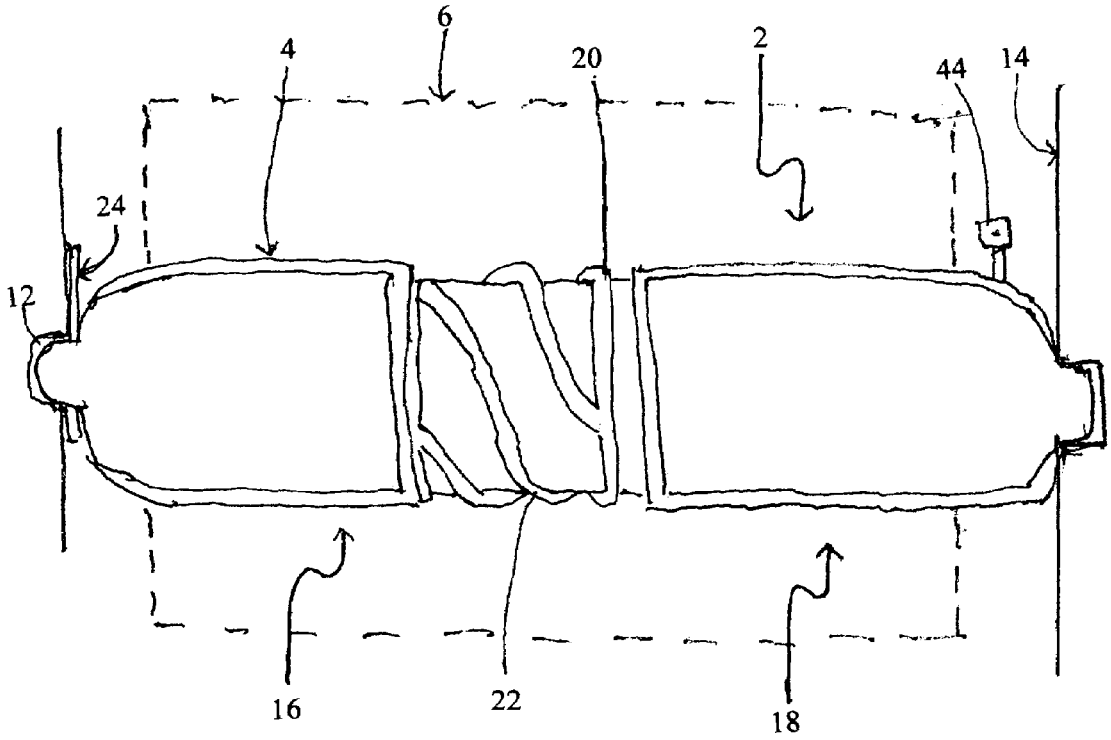
FIG. 1 is a side elevational view of the device of the present invention.
Figure 2:
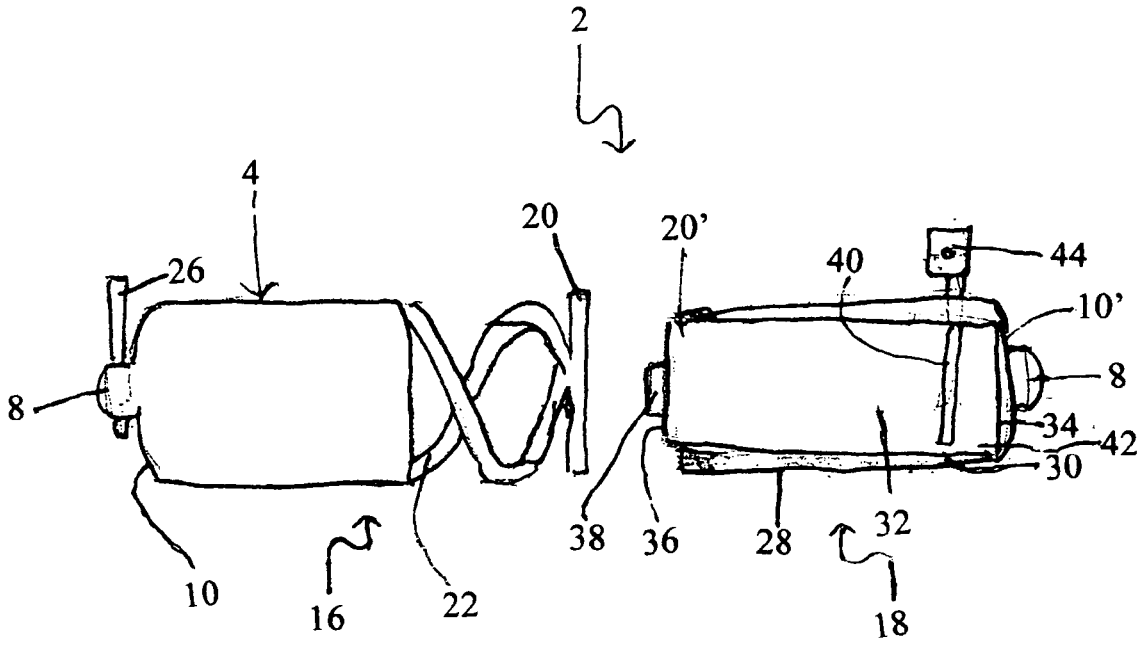
FIG. 2 is a longitudinal cut-away view of the device.
Figure 3:
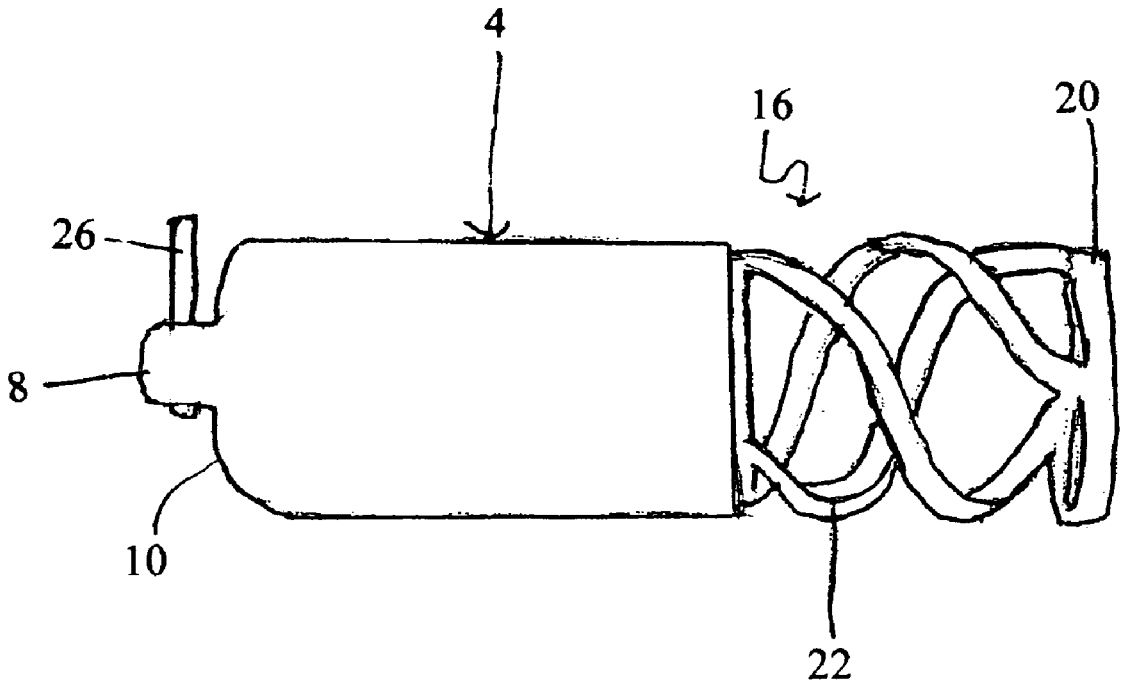
FIG. 3 is a side elevational view of the first piece of the device.
Figure 4:
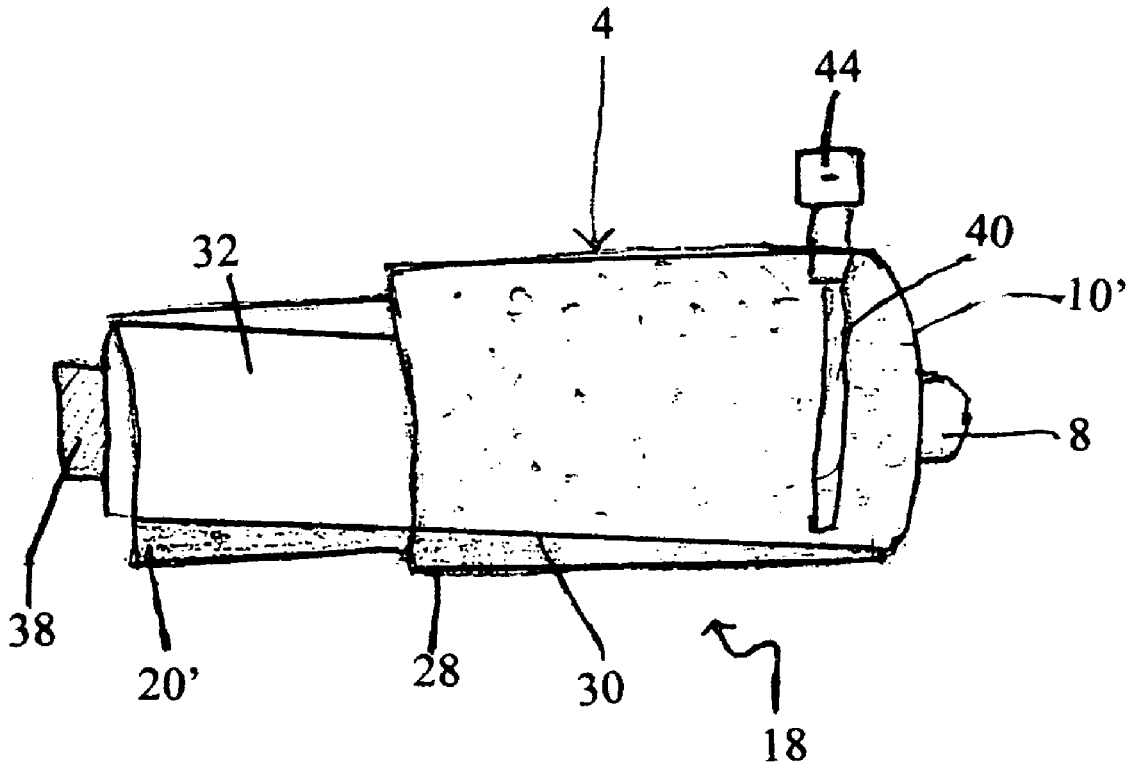
FIG. 4 is a side cut-away view of the second piece of the device.

The invention will now be described with reference to the Figures, wherein like reference numerals refer to like parts throughout the description.

The device 2 of the present invention contains a mandrel 4 for holding a conventional roll 6 of toilet paper. The mandrel 4 contains nubs 8 on the ends 10, 10' thereof and is so sized that the nubs 8 fit into the holes 12 of a conventional holder 14 for rolls 6 of toilet paper.

The mandrel 4 is made up of a first piece 16 and a second piece 18.

The first piece 16 is hollow. It has a proximal end 20 and a distal end 10. There is a spring 22 at the proximal end 20 which maintains outward (distal) pressure on the two pieces 16, 18 so as to keep the nubs 8 of the mandrel 4 in the holes 12 of the holder 14. The nub 8 of the first piece 16 contains a longitudinal roll stabilizer 24 which, by friction against the wall of the holder 14, holds the mandrel 4 in an upright position and prevents turning. The roll stabilizer 24 may be in the form of a pin 26 passing through a hole in the nub 8 or, preferably, it may be made as a single piece with the remainder of the first piece 16.

The second piece 18 contains a proximal end 20' which abuts with the proximal end 20 of the first piece 16 and a distal end 10' which holds a nub 8. The bottom 28 of the second piece 18 contains a tilted platform 30. An enclosure 32 for a desired liquid fits along the tilted platform 30 in such a way that the distal end 34 of the enclosure 32 will be maintained at a lower level than the proximal end 36 of the enclosure 32. The enclosure 32 contains a refill cap 38 which may fit onto the enclosure 32 by friction fit or thread fit.

The desired liquid held in the enclosure 32 may comprise at least one of a disinfectant, a deodorizer, water, a skin moisturizer, an anesthetic agent, a skin softener, or any other liquid conventionally used to wet toilet paper.

The distal end 34 of the enclosure 32 contains a dip tube 40 containing an open port located such that it will be near the lowest point 42 of the enclosure 32. A spring-loaded actuator 44 may be manually pushed down. When this is done, the desired liquid flows upwardly through the dip tube 40 and exits the actuator 44 as a spray. The spray is directed in such a way that it will wet pieces of toilet paper which have been removed from the roll 6 and are held in front of the actuator 44.

In practice, pieces of dry toilet paper are removed from the roll 6 and used to remove fecal material from the anal area. A final cleaning and treating step may be carried out by removing several pieces of toilet paper from the roll 6, holding them in front of the actuator 44, pressing down on the actuator 44 to wet these pieces with the desired fluid and applying these pieces to the anal area. It can readily be seen that the present invention provides a device 2 for holding a desired fluid, which device 2 does not take up space as do the prior art devices. Also, the device 2 of this invention can be used selectively to wet only those pieces of toilet paper which are desired to be wet while the remaining pieces are left dry so that the ideal method of wiping may be carried out.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. In a device for dispensing a desired liquid on toilet paper comprising a hollow mandrel having a first piece and a second piece, the improvement comprising:

a) the first piece contains a distal nub having a roll stabilizer and a proximal spring for applying distal pressure to the first and second pieces and b) the second piece contains a distal nub, a bottom which contains a tilted platform, an enclosure having a bottom for containing a desired liquid, a manually-controlled actuator, and a dip tube extending from the actuator to near the bottom of the enclosure.

2. The device of claim 1, wherein the enclosure contains a refill cap.

3. The method of wiping following a bowel movement comprising:

a) wiping the anal area with pieces of dry toilet paper to remove adhering fecal material and b) following step a), wiping the anal area with pieces of toilet paper containing a desired liquid, which pieces of toilet paper have been wet by a device comprising a hollow mandrel having a first piece and a second piece, the first piece containing a distal nub having a roll stabilizer and a proximal spring for applying distal pressure to the first and second pieces and the second piece containing a distal nub, a bottom which contains a tilted platform, an enclosure having a bottom for containing a desired liquid, a manually-controlled actuator, and a dip tube extending from the actuator to near the bottom of the enclosure.

* * * * *